US008534424B2

(12) United States Patent
Palazzolo

(10) Patent No.: US 8,534,424 B2
(45) Date of Patent: Sep. 17, 2013

(54) AUTOMOTIVE TURBOCHARGER WITH INTEGRAL LUBRICATING OIL FILTER

(75) Inventor: Christopher Kelly Palazzolo, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 898 days.

(21) Appl. No.: 12/207,667

(22) Filed: Sep. 10, 2008

(65) Prior Publication Data

US 2010/0059317 A1 Mar. 11, 2010

(51) Int. Cl.
*F01M 1/00* (2006.01)

(52) U.S. Cl.
USPC ..... 184/6.16; 415/175

(58) Field of Classification Search
USPC ..... 184/6.3, 6.4, 6.11, 6.16, 6.24; 60/602, 60/605.3; 417/407; 415/175; 123/196 R
See application file for complete search history.

(56) References Cited

U.S. PATENT DOCUMENTS

| | | | | | |
|---|---|---|---|---|---|
| 3,057,436 | A * | 10/1962 | Jacobson et al. | ..... | 184/6.3 |
| 3,368,679 | A * | 2/1968 | Bozek | ..... | 210/90 |
| 4,053,409 | A * | 10/1977 | Kuhfuss, Jr. | ..... | 210/130 |
| 4,126,997 | A * | 11/1978 | Henson | ..... | 60/605.3 |
| 5,499,693 | A * | 3/1996 | Widenhorn | ..... | 184/6.24 |
| 5,645,720 | A * | 7/1997 | Godines | ..... | 210/282 |
| 6,379,537 | B1 * | 4/2002 | Brieden et al. | ..... | 210/90 |
| 7,040,874 | B1 * | 5/2006 | Martin et al. | ..... | 417/407 |
| 2009/0158732 | A1 * | 6/2009 | Weisz | ..... | 60/602 |

* cited by examiner

*Primary Examiner* — William E Dondero
*Assistant Examiner* — Robert T Reese
(74) *Attorney, Agent, or Firm* — Julia Voutyras; Alleman Hall McCoy Russell & Tuttle LLP

(57) ABSTRACT

A turbocharger includes a housing, a rotating assembly mounted within the housing, a lubrication passage for admitting lubricating oil into the turbocharger, and a lube oil filter, mounted within a portion of the lubrication passage so that oil entering the turbocharger will pass through the lube oil filter, removing any contaminants arising from the engine's lubrication system.

15 Claims, 2 Drawing Sheets

AUTOMOTIVE TURBOCHARGER WITH INTEGRAL LUBRICATING OIL FILTER

BACKGROUND OF THE INVENTION

1. Field of the Invention

The present invention relates to a turbocharger having a dedicated oil filter for removing contaminants from lubricating oil flowing into the turbocharger.

2. Disclosure Information

Turbochargers have been used with internal combustion engines for many years. Most turbochargers typically employ one or more bearings which permit operation of the turbocharger at extremely high rotational speeds and under very demanding thermal conditions. Needless to say, turbocharger bearings are very precisely constructed and, as such, are subject to severe damage if fouled by foreign matter. The present inventors have determined that a likely cause for turbocharger failure is insufficient cleanliness within an engine at initial startup. During machining of an engine, and particularly during the machining of various passages within a cylinder block, crankshaft, and other parts, particles of metal and other detritus are generated. Such particles, if not removed during subsequent washing operations, will have the capacity to quickly damage turbocharger bearings if the particles are carried into the turbocharger by lubricating oil flowing into the turbocharger.

Unfortunately, it is not possible for turbochargers to have a sealed lubrication system because, unlike superchargers, turbochargers are subjected to such thermal stress that it is necessary that oil be circulated from the engine's primary lubrication system to manage the heat buildup within the turbocharger.

It would be desirable to provide a filter for intercepting foreign matter flowing in lubrication oil to a turbocharger, so as to avoid damage to the turbocharger.

SUMMARY OF THE INVENTION

According to an aspect of the invention, an automotive turbocharger includes a housing and a rotating assembly mounted within the housing. A lubrication passage admits lubricating oil into the turbocharger, and a lube oil filter mounted within a portion of the lubrication passage filters the oil such that all oil entering the turbocharger will pass through the lube oil filter. According to another aspect of the present invention, the lubrication passage is furnished with oil under pressure from an engine lubrication system. The lube oil filter may be either attached to an external port formed as a portion of the lubrication passage which admits lubricating oil into the turbocharger. This external port may be configured within a turbocharger mounting pedestal. As yet another alternative according to the present invention, a turbocharger lube oil filter may include a filter element housed completely within a lubrication passage extending within the turbocharger, with the filter element and the lubrication passage defining an outer annular inflow passage and an axially directed outflow passage.

According to another aspect of the present invention, a cartridge type of filter element may also be housed within a portion of a lubrication passage formed within a turbocharger mounting pedestal.

According to another aspect of the present invention, a turbocharger mounting pedestal having a filter as described above, receives lubricating oil directly from a lubrication passage configured within a cylinder block of an engine.

It is an advantage of an automotive turbocharger according to the present invention that the service life of the turbocharger will be enhanced because the turbocharger receives only oil which has been filtered at the last possible moment, so as to prevent contamination of the oil from machining debris, carbon particles, or any other type of dirt or foreign matter which can be carried within lube oil circulating within the engine's primary lubrication system.

It is yet another advantage of a turbocharger according to the present invention that the oil filter cartridge may be changed during operation of scheduled service of the engine, so as to further prolong the life of the turbocharger, without the necessity of removing the turbocharger from the engine.

Other advantages, as well as features, of the present invention will become apparent to the reader of this specification.

DETAILED DESCRIPTION OF THE PREFERRED EMBODIMENTS

Figure 1:
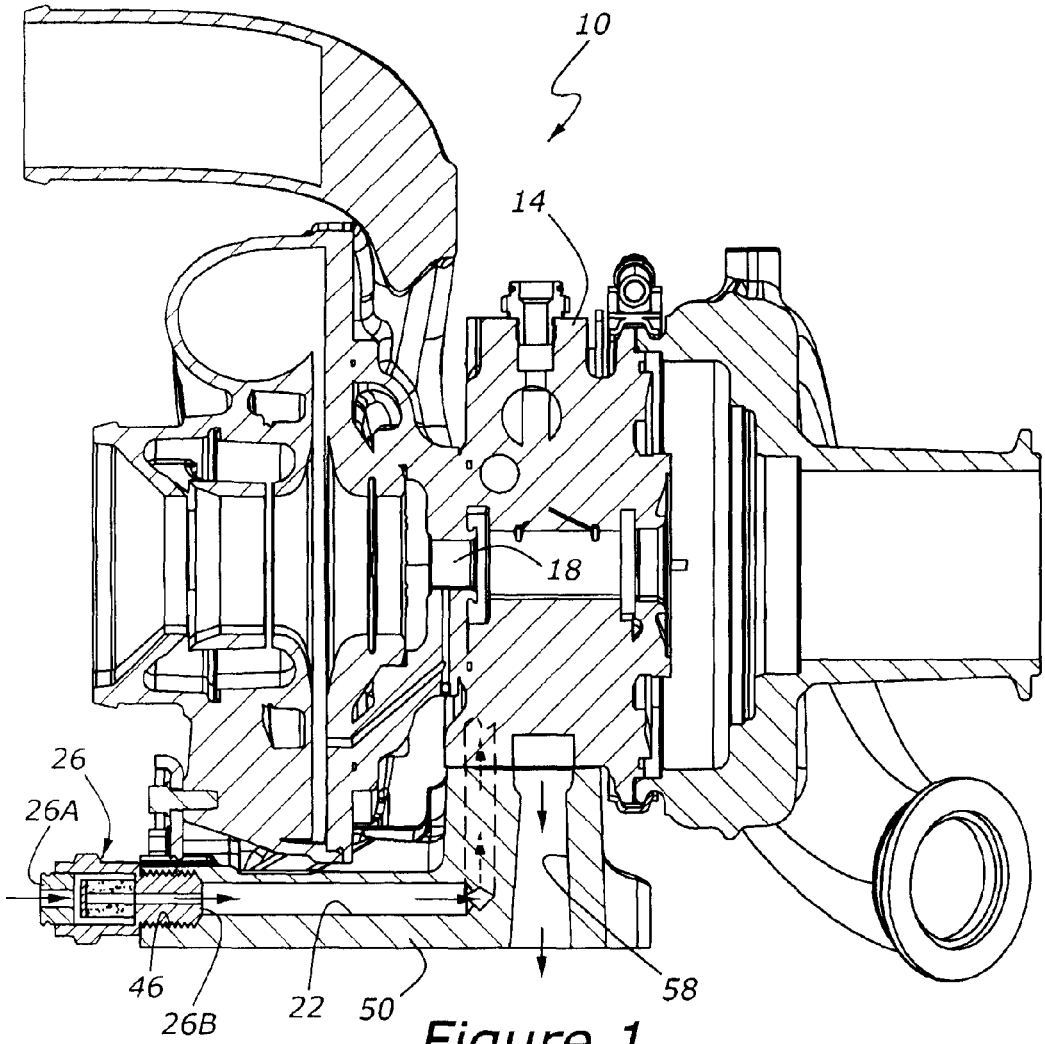
FIG. 1 is a partially schematic sectional view of a turbocharger having an oil filter according to an aspect of the present invention.
Figure 2:
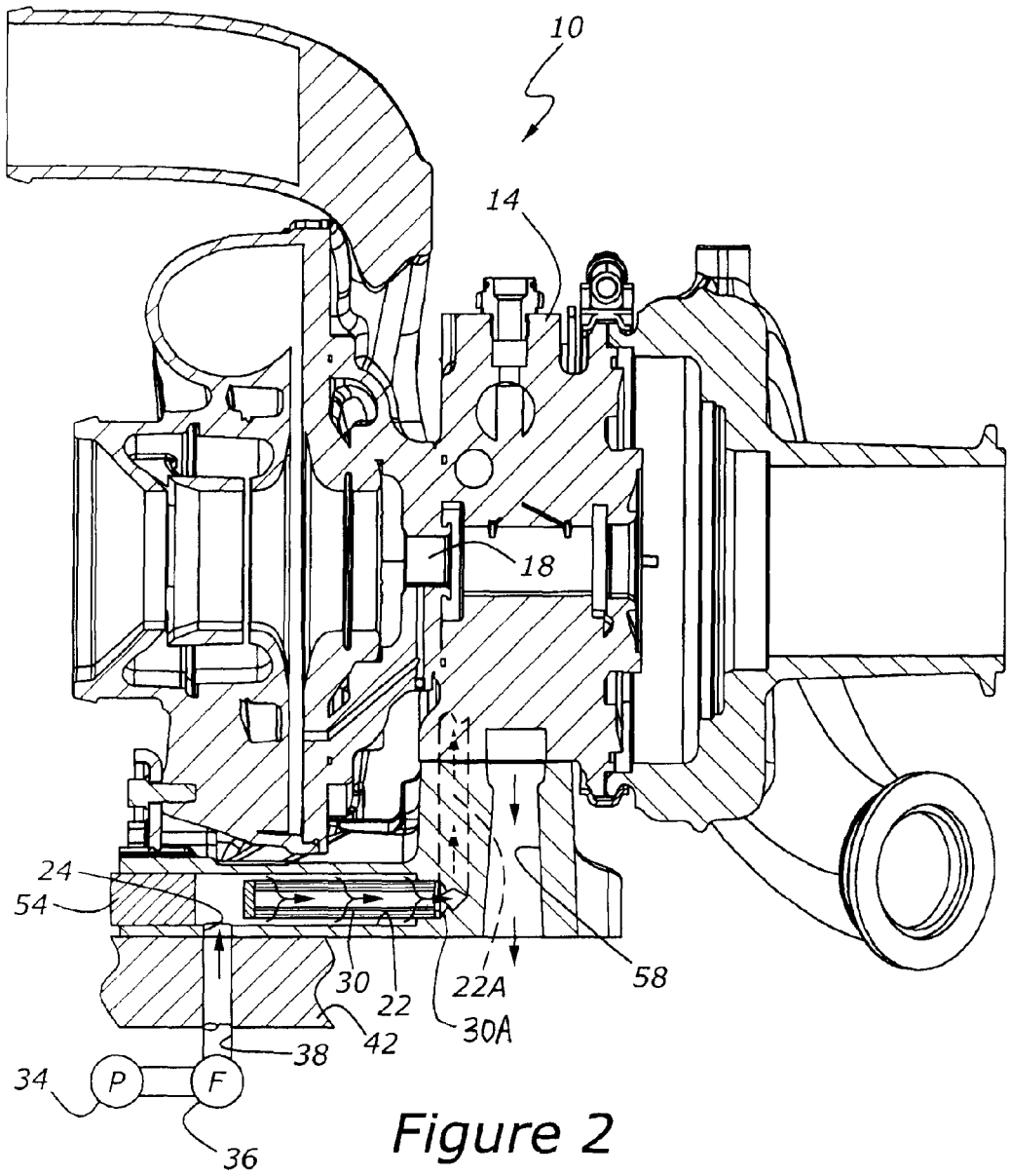
FIG. 2 is a partially schematic sectional view of a turbocharger having an oil filter according to another aspect of the present invention.

As shown in FIGS. 1 and 2, turbocharger 10 includes a housing 14 and a rotating assembly 18, which typically includes a compressor and a turbine on a common shaft supported by one or more bearings. A lubrication passage, 22, admits lubricating oil into turbocharger 10. Two types of lube oil filters are illustrated, with both being mounted within a portion of lubrication passage 22 so that all oil entering the turbocharger will pass through the lube oil filter.

FIG. 1 illustrates a screw-in filter, 26, which is threaded into an external port, 46, formed as a portion of lubrication passage 22. Lubricating oil enters first end, 26A, of filter 26, and exits through second end, 26B, of filter 26, before passing into lubrication passage 22. Oil within lubrication passage 22 flows upwardly through turbocharger mounting pedestal 50 and into housing 14, where it lubricates the bearings (not shown) of turbocharger 10. In general, filter 26 is preferably configured to remove particles having a size greater than about 20 microns.

FIG. 2 illustrates another embodiment of a turbocharger filter according to the present invention which a cartridge type of filter element, 30, is housed within lubrication passage 22. Element 30 has a discharge end 30A, which allows oil to flow into the ascending portion of lubrication passage 22. This ascending portion is shown at 22A in FIG. 2. Oil flowing into passage 22A through inlet port 24 originates from engine oil pump 34 and primary filter 36. Oil leaving filter 36 flows through high-pressure oil passage 38, which is formed within cylinder block 42. A purpose of filter 30 is to remove any contaminants lurking about passage 38 downstream of primary filter 36. With the embodiments of both FIGS. 1 and 2, oil returns from turbocharger 10 to the engine's lubrication system through return passage 58 formed in pedestal 50.

Oil filter cartridge 30 is confined within passage 22 by a plug, 54, which may be fastened removably, so as to permit periodic renewal or cleaning of cartridge 30. In any event, lubricating oil flowing about the outer periphery of cartridge 30 first passes radially inward through the walls of cartridge 30. Oil having flowed radially inwardly then passes axially outward through end 30A of cartridge 30 and into portion 22A of lubrication passage 22. As noted above, plug 54 may be threaded, and therefore removable, allowing extraction and replacement of cartridge 30 during servicing of an engine equipped with the present turbocharger lubrication oil filter. With both of the illustrated embodiments, all oil entering turbocharger 10 will be filtered at the last possible moment, thereby enhancing turbocharger useful life and performance. Those skilled in the art will appreciate in view of this disclosure that several different types of filter media may be employed with the present invention. For example, sintered metal, folded paper, wire mesh, and yet other types of filters are available and may be specified according to the needs of any particular engine and turbocharger. This detail is beyond the scope of the present invention.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A turbocharger for an engine, comprising:

a rotatable assembly inside a housing;

a separate pedestal coupling the housing to the engine, and arranged opposite the rotatable assembly and including a first passage through which lubricant from the engine is conducted into the housing, and a second passage through which lubricant from the housing is conducted back to the engine; and a lubricant filter fit to the pedestal at an upstream end of the first passage.

2. The turbocharger of claim 1 wherein the first passage is configured to receive pressurized lubricant from the engine.

3. The turbocharger of claim 1 wherein the lubricant filter is configured to remove contaminant material of a size greater than 20 microns.

4. The turbocharger of claim 1 wherein the pedestal includes a port formed at the upstream end of the first passage configured to receive the lubricant filter.

5. The turbocharger of claim 4 wherein the port is a threaded port, and wherein the lubricant filter is a screw-in filter.

6. The turbocharger of claim 1 wherein the lubricant filter is seated within the first passage.

7. The turbocharger of claim 1 wherein the lubricant filter is arranged inside the pedestal.

8. The turbocharger of claim 1 wherein the pedestal is coupled to a cylinder block of the engine, wherein the first passage receives the lubricant directly from the cylinder block, and wherein the second passage returns the lubricant back directly to the cylinder block.

9. The turbocharger of claim 1 wherein the rotatable assembly includes coupled compressor and turbine elements rotatable on a lubricated bearing.

10. The turbocharger of claim 1 wherein the pedestal has an external linear surface that interfaces with a linear external surface of the housing.

11. The turbocharger of claim 10 wherein an outlet of the first passage and an inlet of the second passage are formed at the interfacing linear surfaces.

12. The turbocharger of claim 1 wherein the pedestal is positioned in face-sharing contact with the housing and interfaces with the housing at a linear surface at which openings of both the first and second passages are positioned adjacent one another.

13. A turbocharger for an engine, comprising:

a rotatable assembly inside a housing;

coupling the housing to the engine, a pedestal arranged opposite the rotatable assembly and including a first passage through which lubricant from the engine is conducted into the housing, and a second passage through which lubricant from the housing is conducted back to the engine; and a lubricant filter arranged inside the pedestal and seated within the first passage at an upstream end of the first passage, wherein the first and second passages conduct the lubricant through a portion of the pedestal in parallel but opposite directions, and wherein the pedestal includes a removable plug sealing an opening of the first passage, wherein removal of the plug allows the lubricant filter to be withdrawn from or inserted back into the first passage.

14. The turbocharger of claim 13 wherein the pedestal is coupled to a cylinder block of the engine, wherein the first passage receives the lubricant directly from the cylinder block, and wherein the second passage returns the lubricant back directly to the cylinder block.

15. A turbocharger, comprising:

a housing;

a rotatable assembly mounted within the housing;

a first lubrication passage for admitting lubricating oil into the turbocharger;

a second lubrication passage for returning the lubricating oil from the turbocharger; and a lubricating oil filter including an inlet and an outlet arranged along a single axis, the filter mounted within a portion of the first lubrication passage, so that all lubricating oil entering the filter enters and exits the filter in the same direction;

wherein the filter is attached to an external port formed in a mounting pedestal of the turbocharger as the portion of the first lubrication passage, with lubricating oil entering the inlet and passing through the outlet and into the first lubrication passage, this portion of the lubricating oil filter including only an oil passage and a threaded stud that enters the first lubrication passage; and wherein the first and second lubrication passages are adjacent each other in the mounting pedestal.

* * * * *